US010294957B2

(12) United States Patent
Rosen et al.

(10) Patent No.: US 10,294,957 B2
(45) Date of Patent: May 21, 2019

(54) FAN ROTOR BLADE HAVING AN OPTIMIZED BLADE ROOT

(71) Applicant: HAMILTON SUNDSTRAND CORPORATION, Windsor Locks, CT (US)

(72) Inventors: Seth E. Rosen, Middletown, CT (US); Eric Chrabascz, Longmeadow, MA (US); Mark Vignali, Northfield, CT (US); Harold W. Hipsky, Willington, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 300 days.

(21) Appl. No.: 14/885,614

(22) Filed: Oct. 16, 2015

(65) Prior Publication Data

US 2017/0108001 A1 Apr. 20, 2017

(51) Int. Cl.

| | |
|---|---|
| ***F04D 29/32*** | (2006.01) |
| ***F04D 29/38*** | (2006.01) |
| ***F04D 19/00*** | (2006.01) |
| *F01D 5/14* | (2006.01) |

(52) U.S. Cl.
CPC ..... *F04D 29/388* (2013.01); *F04D 19/002* (2013.01); *F04D 29/384* (2013.01); *F01D 5/141* (2013.01); *F04D 29/324* (2013.01); *F05D 2250/74* (2013.01)

(58) Field of Classification Search
CPC ..... F04D 29/324; F01D 5/141; F05D 2250/74
See application file for complete search history.

(56) References Cited

U.S. PATENT DOCUMENTS

| | | | | |
|---|---|---|---|---|
| 7,497,663 | B2 | 3/2009 | McRae, Jr. et al. | |
| 8,105,043 | B2 * | 1/2012 | Tsifourdaris | F01D 5/14 416/223 R |
| 8,523,530 | B2 | 9/2013 | Merritt et al. | |
| 8,529,210 | B2 | 9/2013 | Merritt et al. | |
| 9,631,496 | B2 * | 4/2017 | Vignali | F01D 5/141 |

* cited by examiner

*Primary Examiner* — Justin D Seabe
*Assistant Examiner* — Behnoush Haghighian
(74) *Attorney, Agent, or Firm* — Cantor Colburn LLP

(57) ABSTRACT

A fan rotor blade extending radially from a hub is described. The fan rotor blade may include first surface and a second surface, where the first surface and second surfaces are respectively defined by a set of X-coordinates, Y-coordinates and Z-coordinates. The X, Y and Z coordinates can be set out in any of Tables T-1, T-2, E-1, and E-2. The X, Y, and Z-coordinates can also be scaled by a predetermined factor, with the X-coordinates are oriented in a tangential direction, the Z-coordinates are oriented in an axial direction, and the Y-coordinates are oriented in a radial direction.

6 Claims, 5 Drawing Sheets

FAN ROTOR BLADE HAVING AN OPTIMIZED BLADE ROOT

BACKGROUND OF THE INVENTION

The subject matter disclosed herein relates to a fan rotor blade and, more particularly, to a fan rotor blade having an optimized blade root.

Fan rotors for air cycle machines generally include a plurality of fan rotor blades disposed equidistant from one another around a central hub. Air cycle machine fan rotors often experience extreme temperatures, rotational forces and bearing loads. Over time, the fan rotor blades wear out due to cracking and/or weakening at the blade root, where the blades are in connection with a central hub. It may be advantageous to configure a fan rotor blade to have an optimized blade root that reduces peak blade stresses and improves fatigue life while maintaining aerodynamic performance.

BRIEF DESCRIPTION OF THE INVENTION

In one embodiment, a fan rotor blade extending radially from a hub is described. The fan rotor blade may include first surface and a second surface, where the first surface and second surfaces are respectively defined by a set of X-coordinates, Y-coordinates and Z-coordinates. The X, Y and Z coordinates can be set out in any of Tables T-1, T-2, E-1, and E-2. The X, Y, and Z-coordinates can also be scaled by a predetermined factor, where the X-coordinates are oriented in a tangential direction, the Z-coordinates are oriented in an axial direction, and the Y-coordinates are oriented in a radial direction.

BRIEF DESCRIPTION OF THE DRAWINGS

The subject matter described herein is particularly pointed out and distinctly claimed in the claims at the conclusion of the specification. The foregoing and other features, and advantages of the claimed embodiments are apparent from the following detailed description taken in conjunction with the accompanying drawings in which:

The detailed description explains the embodiments claimed herein, together with advantages and features, by way of example with reference to the drawings.

DETAILED DESCRIPTION OF THE INVENTION

Figure 1:
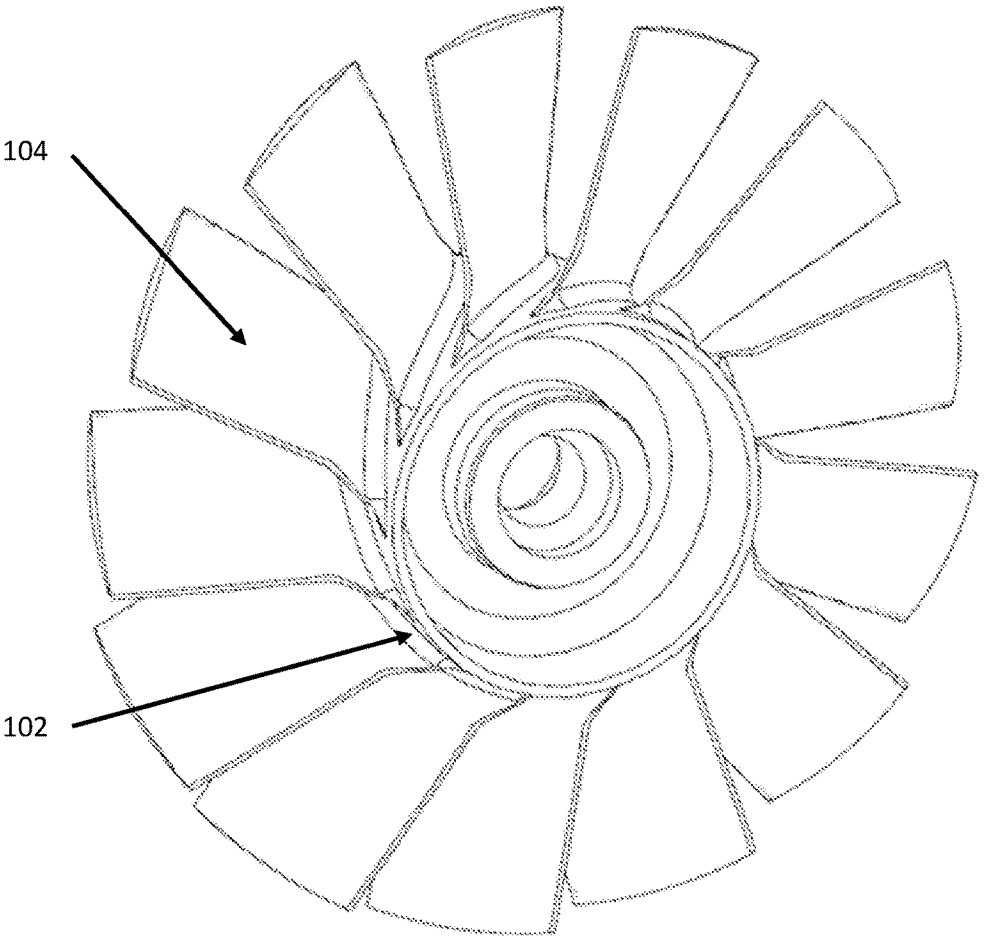
FIG. 1 is a perspective view of a fan rotor having a plurality of fan rotor blades disposed around a hub, according to one or more embodiments.

FIG. 1 is a perspective view of a plurality of fan rotor 100. Fan rotor 100 includes at least one fan rotor blade 104. In some embodiments, as depicted in FIG. 1, fan rotor 100 may include a plurality of fan rotor blades 104 disposed around and connected to a hub 102.

Fan rotor 100 may be manufactured from many metal alloys including (but not limited to) steel, aluminum, nickel, copper, etc. It may be advantageous, according to some embodiments, to construct fan rotor 100 from an alloy of titanium, which may provide an optimal combination of weight to strength ratio, heat resistance, durability, etc. According to some embodiments, rotor 100 and/or fan rotor blade 104 may be machined from AMS4928 titanium, or an alloy having substantially similar properties. According to other embodiments, rotor 100 and/or fan rotor blade(s) 104 may be heat treated to a particular hardness, such as, for example 30-39 HRC. It is contemplated that other materials and heat treatments may accomplish substantially similar structural and operational properties. Embodiments described herein are not intended to be limiting.

Figure 2:
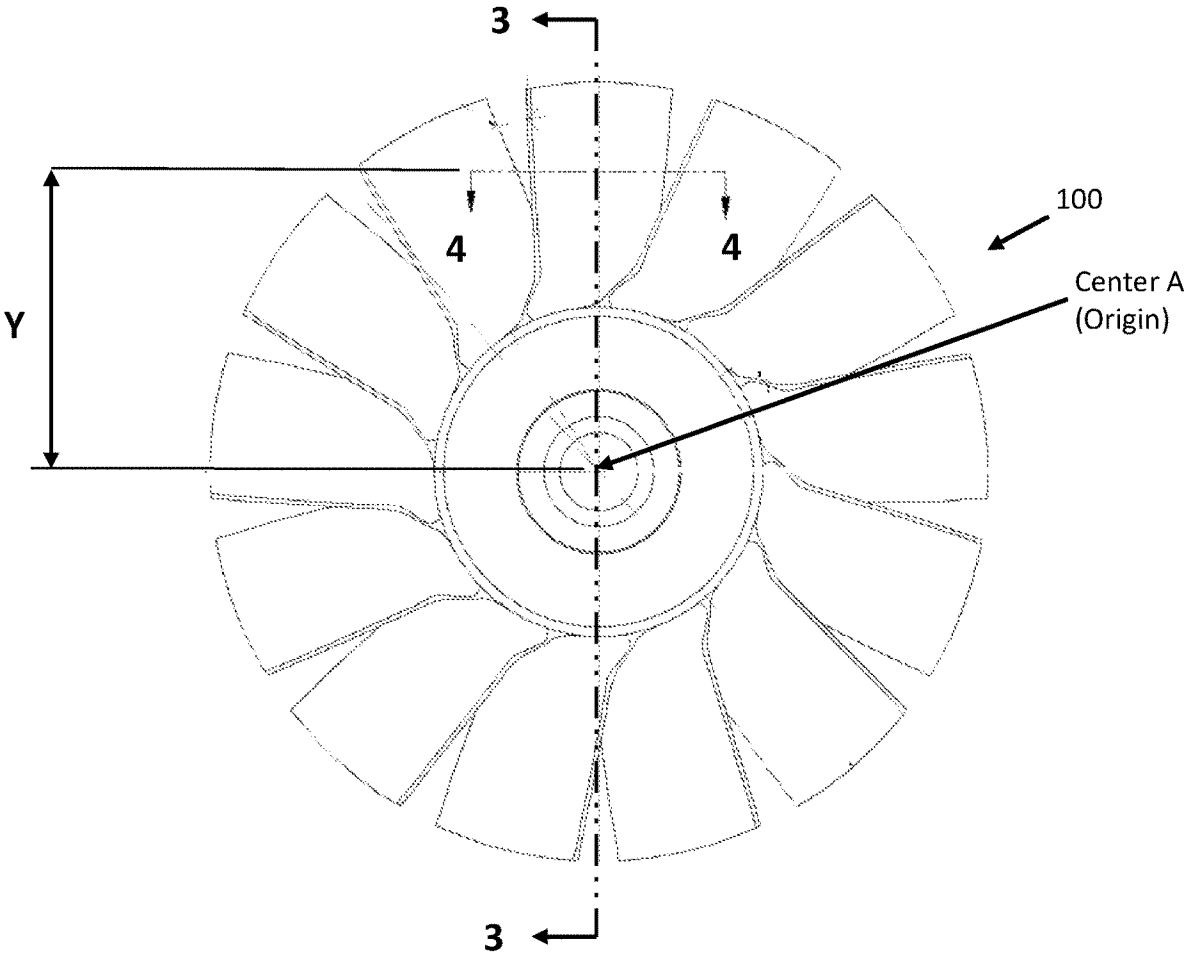
FIG. 2 is a front view of the fan rotor, according to one or more embodiments.
Figure 3:
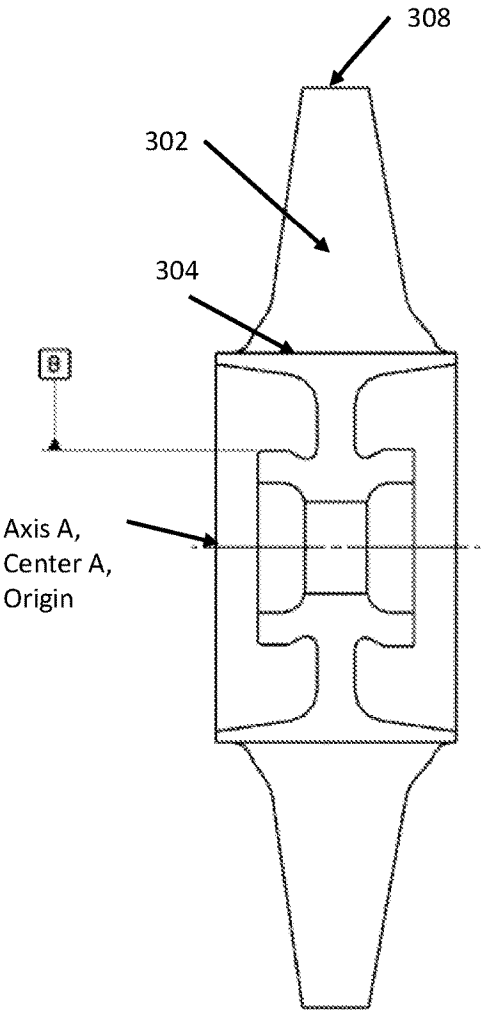
FIG. 3 is a sectional view of the fan rotor taken along 3-3 in FIG. 2, according to one or more embodiments.
Figure 5:
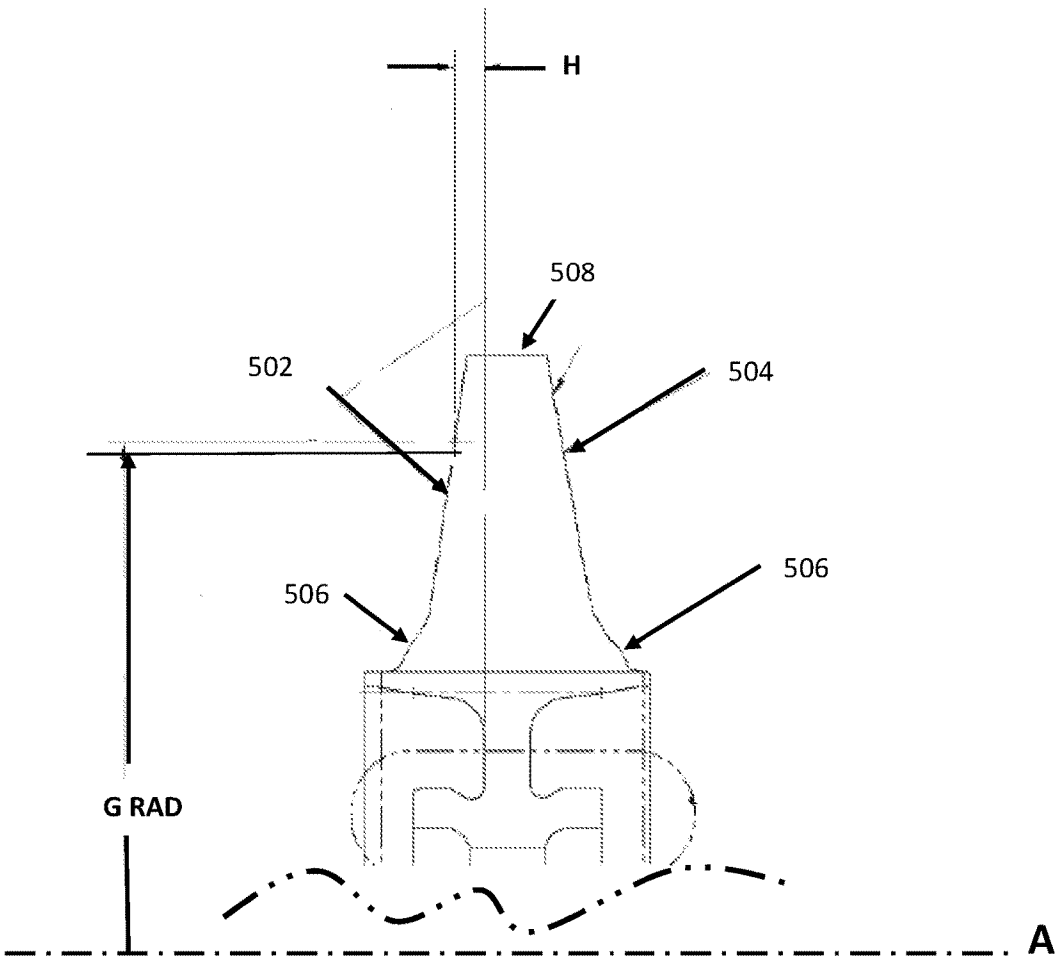
FIG. 5 is a sectional view of the fan rotor blade taken along line 3-3 in FIG. 2, with the tip and hub contours rotated into the drawing for clarity.

With reference to FIG. 2 depicting a front view of fan rotor 100, and FIG. 3 depicting a cross sectional view 3-3 of fan rotor 100, fan rotor 100 generally includes a hub 102 having in connection therewith a plurality of fan rotor blades 104. According to one or more embodiments, the fan rotor blades 104 are equally spaced about hub 102. Each fan rotor blade 104 includes a leading edge and a trailing edge (e.g., leading edge 502 and a trailing edge 504 as depicted in FIG. 5).

The shape of fan rotor blade 104 may be defined by a set of points in, for example, Cartesian coordinates which define a boundary thereof. Referring now to FIG. 3, a section 3-3 of fan rotor blade 104 is depicted. Fan rotor blade 104 extends from a contoured surface 302 transitioning from an axially parallel portion 304 near an axial center (which is also an Axis A) of fan rotor blade 104 to a transverse surface (not shown) that is transverse to the axis at the outer periphery (fan shroud) 308 of fan rotor blade 104.

Figure 4:
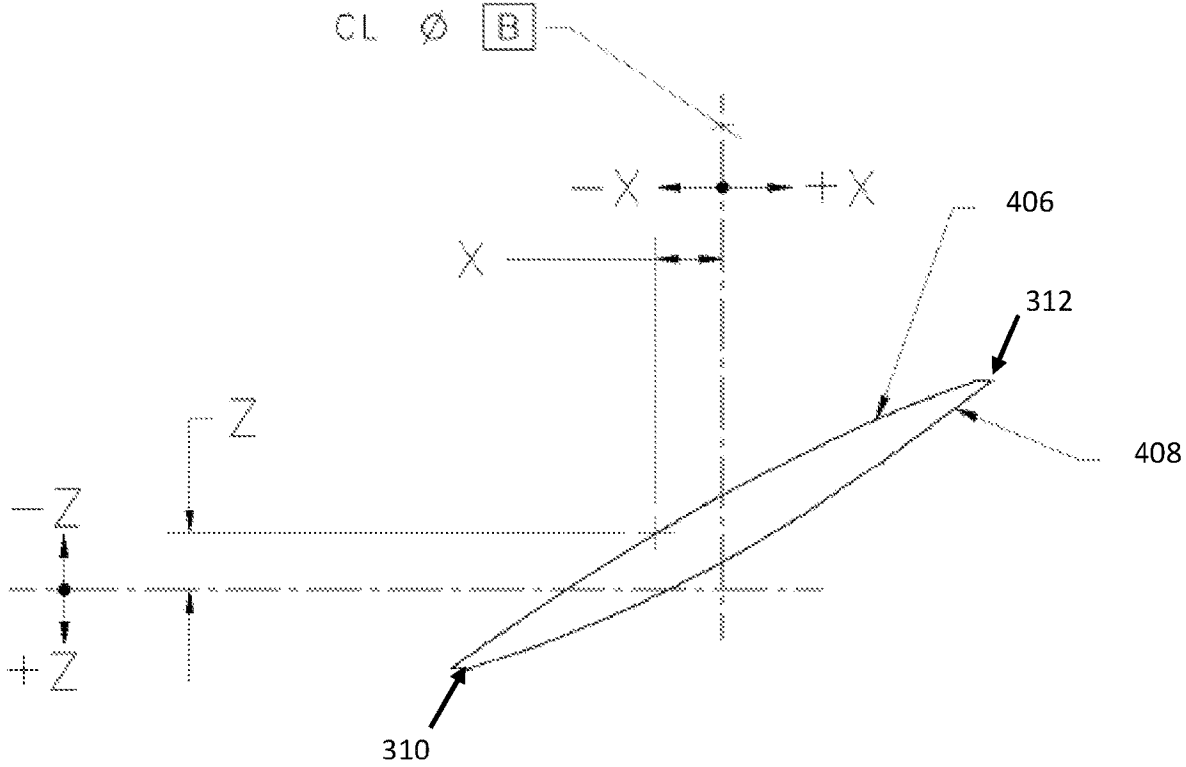
FIG. 4 is a sectional view of the fan rotor taken along line 4-4 in FIG. 2, according to one or more embodiments.

Referring now to FIG. 4, fan rotor blade 104 generally includes a left surface 406 and a right surface 408 that are contoured to provide airflow. The configuration of the left and right surfaces 406 and 408 changes in view of dimensional parameters such as, for example, curvature, thickness, twist, taper from the root 506 (as depicted in FIG. 5) to tip 508 (as depicted in FIG. 5), radius from the fan shroud 308, radius from leading edge 310, and straightness of both of the leading edge 310 and trailing edge 312 from root 506 to tip 508.

Because of the difficulty involved in giving an adequate word description of the three-dimensional surface shape of each fan rotor blade 104 described herein, coordinates for one non-limiting dimensional embodiment therefore are set forth in surface Tables T-1 and T-2 for an embodiment of fan rotor blade 104, and surface Tables E-1 and E-2, respectively describing a leading edge and a trailing edge of fan rotor blade 104. Characteristics of the shape may change from one to another and each may be directly scaled up or scaled down by a desired factor to meet different requirements.

Tables T-1, T-2, E-1, and E-2 are shown in a Cartesian coordinate system for X, Y and Z of the blade surface of fan rotor blade 104. Tables T-1, T-2, E-1, and E-2 include coordinates that may have a manufacturing tolerance approximately equal to ±0.03 inches (0.76 mm) in direction normal to any turbine coordinate location. The Cartesian coordinate system has orthogonally related X, Y and Z axes with the Y-axis extending generally in a radial direction relative to Center A (and Axis A, as depicted in FIG. 3), and related with respect to Datum B (FIG. 3). The X and Z coordinate values for determining the blade surface at each radial location are provided with respect to Y, where Y coordinate values in the Tables disclosed herein represent a non-dimensionalized value equal to the ratio of Y to the diameter at Datum B. That is, the disclosed, non-dimensionalized value Y in the Tables is provided as a ratio with respect to Datum B. It should be understood that a variety of reference datums may alternatively or additionally be used.

TABLE T-1

| Blade Right Surf | | |
|---|---|---|
| X BSC | Z BSC | Ratio (Y BSC/-B-) |
| 0.4300 | −0.2559 | 2.3313 |
| 0.2155 | −0.1499 | 2.3558 |
| 0.0151 | −0.0667 | 2.3639 |
| −0.2236 | 0.0157 | 2.3551 |
| −0.4118 | 0.0703 | 2.3340 |
| −0.3960 | 0.1099 | 2.0599 |
| −0.1714 | 0.0260 | 2.0853 |
| 0.0004 | −0.0528 | 2.0911 |
| 0.1780 | −0.1494 | 2.0848 |
| 0.4077 | −0.3013 | 2.0580 |
| 0.4027 | −0.3644 | 1.7811 |
| 0.1557 | −0.1488 | 1.8128 |
| −0.0600 | −0.0054 | 1.8175 |
| −0.2381 | 0.0885 | 1.8054 |
| −0.4021 | 0.1586 | 1.7813 |
| −0.3716 | 0.1942 | 1.5082 |
| −0.2216 | 0.1176 | 1.5324 |
| −0.0145 | −0.0173 | 1.5455 |
| 0.1761 | −0.1801 | 1.5370 |
| 0.3622 | −0.3920 | 1.5101 |
| 0.3495 | −0.4174 | 1.3542 |
| 0.1515 | −0.1617 | 1.3842 |
| −0.0077 | −0.0124 | 1.3910 |
| −0.2221 | 0.1404 | 1.3763 |
| −0.3862 | 0.2296 | 1.3460 |
| −0.3186 | 0.2189 | 1.2395 |
| −0.1559 | 0.1165 | 1.2649 |
| −0.0091 | 0.0005 | 1.2728 |
| 0.1702 | −0.1841 | 1.2634 |
| 0.3207 | −0.3990 | 1.2390 |
| 0.3489 | −0.4681 | 1.1007 |
| 0.2039 | −0.2159 | 1.1305 |
| −0.0388 | 0.0554 | 1.1450 |
| −0.2646 | 0.2239 | 1.1200 |
| −0.3788 | 0.2905 | 1.0926 |

TABLE T-2

| Blade Left Surf | | |
|---|---|---|
| X BSC | Z BSC | Ratio (Y BSC/-B-) |
| −0.4358 | 0.0516 | 2.3304 |
| −0.2476 | −0.0489 | 2.3531 |
| −0.0167 | −0.1499 | 2.3638 |
| 0.2251 | −0.2317 | 2.3549 |
| 0.4091 | −0.2803 | 2.3344 |
| 0.3782 | −0.3238 | 2.0626 |
| 0.2455 | −0.2719 | 2.0792 |
| −0.0213 | −0.1494 | 2.0910 |
| −0.2178 | −0.0413 | 2.0817 |
| −0.4199 | 0.0886 | 2.0560 |
| −0.4135 | 0.1336 | 1.7791 |
| −0.1956 | −0.0336 | 1.8096 |
| −0.0255 | −0.1488 | 1.8182 |
| 0.1854 | −0.2773 | 1.8105 |
| 0.3617 | −0.3734 | 1.7883 |
| 0.3245 | −0.4126 | 1.5171 |
| 0.1319 | −0.2736 | 1.5410 |
| −0.1102 | −0.0834 | 1.5423 |
| −0.2810 | 0.0637 | 1.5243 |
| −0.3919 | 0.1666 | 1.4019 |
| −0.3948 | 0.2003 | 1.3439 |
| −0.2644 | 0.1681 | 1.3701 |
| −0.0634 | −0.1206 | 1.3899 |
| 0.1430 | −0.3008 | 1.3849 |
| 0.3301 | −0.4553 | 1.3583 |

TABLE T-2-continued

| Blade Left Surf | | |
|---|---|---|
| X BSC | Z BSC | Ratio (Y BSC/-B-) |
| 0.2837 | −0.4490 | 1.2458 |
| 0.0750 | −0.2566 | 1.2710 |
| −0.1507 | −0.0368 | 1.2655 |
| −0.2686 | 0.0848 | 1.2492 |
| −0.3832 | 0.2093 | 1.2242 |
| −0.4018 | 0.2418 | 1.0857 |
| −0.2565 | 0.0707 | 1.1216 |
| −0.0850 | −0.1188 | 1.1429 |
| 0.1393 | −0.3532 | 1.1386 |
| 0.3224 | −0.5391 | 1.1075 |

The existing art provides for blade roots having continuous surfaces at the root (without thickening), and having ordinary fillets at the blade root between the hub and rotor blades (prior art not shown). According to some embodiments, a thickened blade root 506 optimized for aerodynamic performance may increase the strength and durability of high-cycling fan rotors, such as, for example, fan rotor 100, over that of the existing art.

Referring now to FIG. 5, a thickened blade root 506 is depicted. According to some embodiments, blade root 506 may be configured, as embodied in

TABLE E-1

| Leading Edge | |
|---|---|
| H | Ratio (G Rad/-B-) |
| −0.3988 | 0.9521 |
| −0.3971 | 0.9771 |
| −0.3909 | 1.0268 |
| −0.3616 | 1.0966 |
| −0.3311 | 1.1383 |
| −0.3155 | 1.1589 |
| −0.3000 | 1.1796 |
| −0.2728 | 1.2230 |
| −0.2552 | 1.2703 |
| −0.2512 | 1.2950 |
| −0.2473 | 1.3198 |
| −0.2395 | 1.3693 |
| −0.2042 | 1.5922 |
| −0.1807 | 1.7408 |
| −0.1612 | 1.8646 |
| −0.1495 | 1.9389 |
| −0.1299 | 2.0627 |
| −0.1143 | 2.1617 |
| −0.1065 | 2.2113 |
| −0.1026 | 2.2360 |
| −0.0948 | 2.2856 |
| −0.0870 | 2.3351 |
| −0.0792 | 2.3847 |
| −0.0715 | 2.4342 |
| −0.0675 | 2.4590 |

TABLE E-2

| Trailing Edge | |
|---|---|
| H | Ratio (G Rad/-B-) |
| 0.6812 | 0.9619 |
| 0.6808 | 0.9874 |
| 0.6373 | 1.0375 |
| 0.6634 | 1.0614 |
| 0.6502 | 1.0837 |
| 0.6159 | 1.1239 |
| 0.5608 | 1.1814 |
| 0.5446 | 1.2021 |
| 0.5171 | 1.2463 |

TABLE E-2-continued

| Trailing Edge | |
|---|---|
| H | Ratio (G Rad/-B-) |
| 0.5081 | 1.2703 |
| 0.5030 | 1.2953 |
| 0.4931 | 1.3454 |
| 0.4486 | 1.5706 |
| 0.3945 | 1.8458 |
| 0.3798 | 1.9209 |
| 0.3552 | 2.0460 |
| 0.3454 | 2.0961 |
| 0.3406 | 2.1211 |
| 0.3308 | 2.1712 |
| 0.3162 | 2.2463 |
| 0.3017 | 2.3214 |
| 0.2920 | 2.3715 |
| 0.2872 | 2.3965 |
| 0.2775 | 2.4466 |
| 0.2726 | 2.4716 |

Tables T-1, T-2, E-1, and E-2, to maximize strength of the base of rotor blade 104 by thickening the root in a way that provides particular aerodynamic properties. According to some embodiments, thickened blade root 506 may reduce peak rotor blade stresses and improve fatigue life of rotor 100 while maintaining aerodynamic performance. The aerodynamic performance of rotor blade 104 is enhanced with the configuration for a thickened blade root 506 as depicted in FIG. 5 and specified herein in the Tables.

The tip contour of rotor fan blade 104 is defined dimensionally herein by a paired axial dimension H and radial dimension G. The paired dimensions H and G describing leading edge 310 and trailing edge 312 are provided in Table E-1 and E-2, respectively.

By defining X and Z coordinate values at selected locations in the radial direction, e.g., in a Y direction with respect to Datum B, the left and right surfaces of the blade are ascertained. By connecting the X and Z values with smooth continuing arcs, each profile surface at the associated radial distance Y is defined. The surface profiles at the various radial locations between the radial distances Y are thereby ascertained by connecting adjacent surface profiles. Although the X, Y, and Z axes are oriented in the above fashion, it should be appreciated that the X, Y, and Z axes may have any orientation provided that the axes are orthogonally oriented with respect to each other and one axis extends along a height of the blade.

The Table values are provided in inches, and represent actual blade profiles at ambient, non-operating or non-hot conditions for an uncoated blade, the coatings for which are described below. While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fan rotor blade extending radially from a hub, the fan rotor blade including a first surface and a second surface, wherein:

the first surface and second surfaces are respectively defined by a set of X-coordinates, Y-coordinates and Z-coordinates set out in any of Tables T-1, T-2, E-1, and E-2;

the X, Y, an Z-coordinates scaled by a predetermined factor; and the X-coordinates are oriented in a tangential direction, the Z-coordinates are oriented in an axial direction, and the Y-coordinates are oriented in a radial direction, wherein an origin of the X, Y and Z coordinates is at an axial and radial center of the hub.

2. The fan rotor blade of claim 1, wherein the fan rotor blade comprises a tip contour defined by a set of points as defined in Tables E-1 and E-2 scaled to a predetermined factor, the set of points including paired axial dimensions H from a reference surface and radial dimensions G from a center line of the hub.

3. The fan rotor blade of claim 1, wherein the Z coordinates are non-dimensionalized values equal to a ratio of a dimension Z to a predetermined diameter at datum B.

4. The fan rotor blade of claim 1, wherein the fan rotor blade is manufactured from titanium.

5. The fan rotor blade of claim 3 wherein each of the coordinates in the Tables is adjusted by a manufacturing tolerance.

6. The fan rotor blade of claim 5, wherein the manufacturing tolerance is ±0.03 inches.

* * * * *